US012252296B2

(12) United States Patent
Suzuki

(10) Patent No.: US 12,252,296 B2
(45) Date of Patent: Mar. 18, 2025

(54) DRIPPING CONTAINER COVER

(71) Applicant: GC CORPORATION, Shizuoka (JP)

(72) Inventor: Takumi Suzuki, Tokyo (JP)

(73) Assignee: GC CORPORATION, Shizuoka (JP)

( * ) Notice: Subject to any disclaimer, the term of this patent is extended or adjusted under 35 U.S.C. 154(b) by 66 days.

(21) Appl. No.: 17/793,780

(22) PCT Filed: Sep. 1, 2020

(86) PCT No.: PCT/JP2020/033020
§ 371 (c)(1),
(2) Date: Jul. 19, 2022

(87) PCT Pub. No.: WO2021/171659
PCT Pub. Date: Sep. 2, 2021

(65) Prior Publication Data

US 2023/0059576 A1 Feb. 23, 2023

(30) Foreign Application Priority Data

Feb. 26, 2020 (JP) ..... 2020-030123

(51) Int. Cl.
*B65D 25/34* (2006.01)
*B65D 47/18* (2006.01)

(52) U.S. Cl.
CPC ..... *B65D 25/34* (2013.01); *B65D 47/18* (2013.01)

(58) Field of Classification Search
CPC ..... B65D 25/34; B65D 25/38; B65D 47/18; B65D 47/20; B65D 47/00
(Continued)

(56) References Cited

U.S. PATENT DOCUMENTS 2,857,079 A * 10/1958 Hall ..... B65D 35/28 222/103
4,326,647 A * 4/1982 Pool ..... B65D 35/28 222/105

(Continued)

FOREIGN PATENT DOCUMENTS

FR 2561210 A * 9/1985 ..... A45D 34/00
JP 10-175683 A 6/1998

(Continued)

OTHER PUBLICATIONS

International Search Report of PCT/JP2020/033020 dated Nov. 17, 2020 [PCT/ISA/210].

*Primary Examiner* — J. Gregory Pickett
*Assistant Examiner* — Niki M Eloshway
(74) *Attorney, Agent, or Firm* — Sughrue Mion, PLLC

(57) ABSTRACT

A dripping container cover includes: a bottom part; a first pressing part; and a second pressing part including a face facing the first pressing part, wherein the above described face and a face of the first pressing part which faces the second pressing part are provided with projections, and wherein a distance between an end of each of the projections, the end being apart from the bottom part further than the other end, and the bottom part is at least a predetermined value and the projections are arranged within both outermost ranges of the storing part assuming that the storing part is divided into four in a width direction thereof or wherein the above distance is less than a predetermined value and the projections are arranged within central ranges of the storing part assuming that the storing part is divided into four in the width direction.

3 Claims, 14 Drawing Sheets

(58) Field of Classification Search
USPC ..... 220/23.91
See application file for complete search history.

(56) References Cited

U.S. PATENT DOCUMENTS

| | | | | |
|---|---|---|---|---|
| 11,247,837 | B1 * | 2/2022 | May | B65D 35/28 |
| 2003/0192909 | A1 * | 10/2003 | Maskell | B65D 75/525 222/105 |
| 2008/0167681 | A1 * | 7/2008 | Stenton | A61B 17/00491 606/213 |
| 2009/0302058 | A1 * | 12/2009 | D' Aguisto, II | B05C 17/00583 222/103 |
| 2021/0061635 | A1 * | 3/2021 | May | A61J 1/065 |
| 2023/0285729 | A1 * | 9/2023 | Wittes | B05C 17/10 |

FOREIGN PATENT DOCUMENTS

| | | | |
|---|---|---|---|
| JP | 2000-085860 | A | 3/2000 |
| JP | 2003-511179 | A | 3/2003 |
| JP | 3572158 | B2 | 9/2004 |
| JP | 2009-207593 | A | 9/2009 |
| JP | 2019-187540 | A | 10/2019 |
| WO | 01/28397 | A1 | 4/2001 |

* cited by examiner

DRIPPING CONTAINER COVER

CROSS REFERENCE TO RELATED APPLICATIONS

This application is a National Stage of International Application No. PCT/JP2020/033020 filed on Sep. 1, 2020, claiming priority based on Japanese Patent Application No. 2020-030123 filed on Feb. 26, 2020.

TECHNICAL FIELD

The present disclosure relates to a dripping container cover fitted to a dripping container that is for dripping a chemical liquid.

BACKGROUND ART

It is important to prevent dripping containers for dripping chemical liquids and thereby taking the chemical liquids out thereof: in particular, dripping containers used for such a chemical liquid that the amount thereof used at one time is small (e.g., approximately one drip), from dripping chemical liquids in an amount different from user's intension. However, actually, more drips of a chemical liquid than user's intension are dripped when, for example, the chemical liquid contains a low boiling point solvent or when the chemical liquid has a low viscosity, which is not a good case. Such a case is considered to be caused by, for example, a change in the viscosity of the chemical liquid caused by a change in temperature due to heat transfer (conduction, radiation) of body temperature from person's fingers, an increase in the internal pressure inside the container due to volatilization of the chemical liquid, and adjustments for force when the container is pressed. Since such a case also occurs conspicuously when a chemical liquid to be kept in cold storage is used, changes in atmosphere temperature before and after the chemical liquid is taken out of a refrigerator is also considered to affect the occurrence.

On the contrary, it may be necessary for a highly viscous chemical liquid to be pressed with a large force for dripping.

For the foregoing, techniques such as Patent Literatures 1 to 3 are disclosed.

Patent Literature 1 discloses a liquid dripping tool equipped with a heat insulating cover so that the cover covers side and bottom faces of a container housing part, wherein a plurality of ribs are formed throughout the inner surface of the heat insulating cover, thereby spaces are formed between the container housing part and the heat insulating cover.

Patent Literature 2 discloses a bottle container including a bottle and a plastic container that is capable of housing and detaching the bottle, wherein the container is provided with a movable piece on a side wall portion thereof.

Patent Literature 3 discloses a dripping container comprising a jacket covering at least side faces of a container housing part at a predetermined interval.

CITATION LIST

Patent Literature

[PTL 1] JP 3572158 B2
[PTL 2] JP 2000-85860 A
[PTL 3] JP 2009-207593 A

SUMMARY OF INVENTION

Technical Problem

An object of the present disclosure is to provide a dripping container cover capable of dripping more certainly as user's intension.

Solution to Problem

One aspect of the present disclosure is a dripping container cover fitted onto a storing part of a dripping container, a chemical liquid being stored in the storing part, the dripping container cover comprising: a bottom part; a first pressing part protruding from the bottom part; and a second pressing part protruding from the bottom part, the second pressing part including a face facing the first pressing part with a gap between the first and second pressing parts, wherein a face of the first pressing part which faces the second pressing part, and the face of the second pressing part, which faces the first pressing part, are each provided with projections, and wherein a distance between an end of each of the projections, the end being apart from the bottom part further than another end thereof, and the bottom part is at least 0.7 times as much as a height of the storing part, which is fitted into the cover, and the projections are arranged only at positions within both outermost ranges of the storing part assuming that the storing part is divided into four in a width direction thereof, or a distance between an end of each of the projections, the end being apart from the bottom part further than the other end, and the bottom part is less than 0.7 times the height of the storing part, which is fitted into the cover, and the projections are arranged only at positions within central ranges of the storing part assuming that the storing part is divided into four in the width direction.

The projections of the first pressing part may be provided at such positions as to be symmetrical to each other with respect to a center of the storing part in the width direction, and the projections of the second pressing part may be provided at such positions as to be symmetrical to each other with respect to a center of the storing part in the width direction.

The faces of the first and second pressing parts, which face the second and first pressing parts, respectively, may be formed to each have a curved concave portion, the curved concave portion including the projections.

Advantageous Effects of Invention

The present disclosure makes it possible to more certainly drip as user's intension according to the positions of projections.

DESCRIPTION OF EMBODIMENTS

First Embodiment

Figure 1:
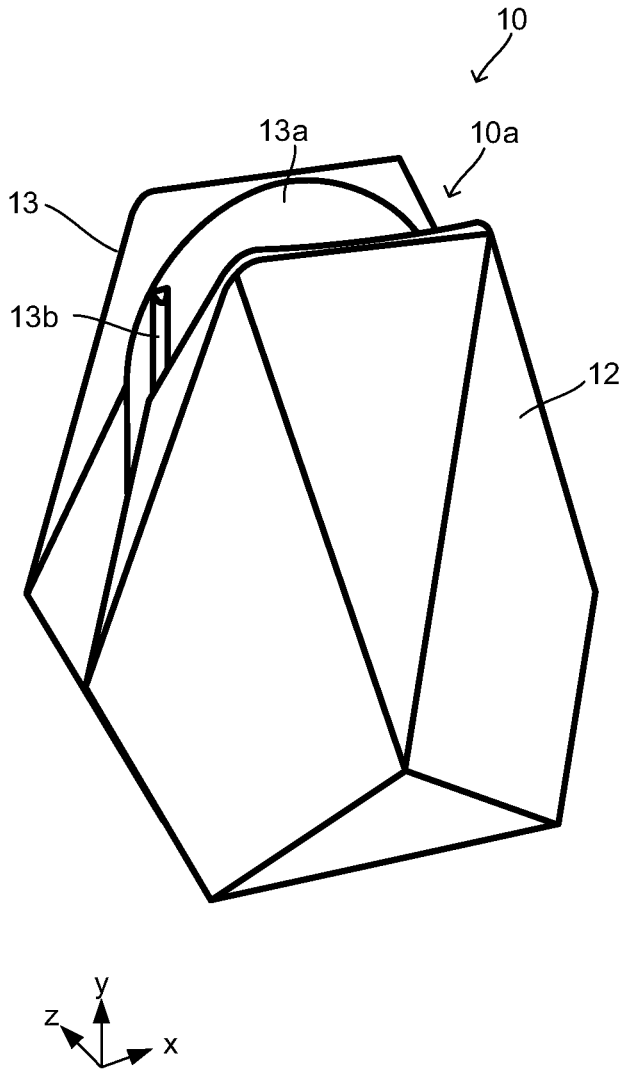
FIG. 1 is a perspective view of a dripping container cover 10.
Figure 2:
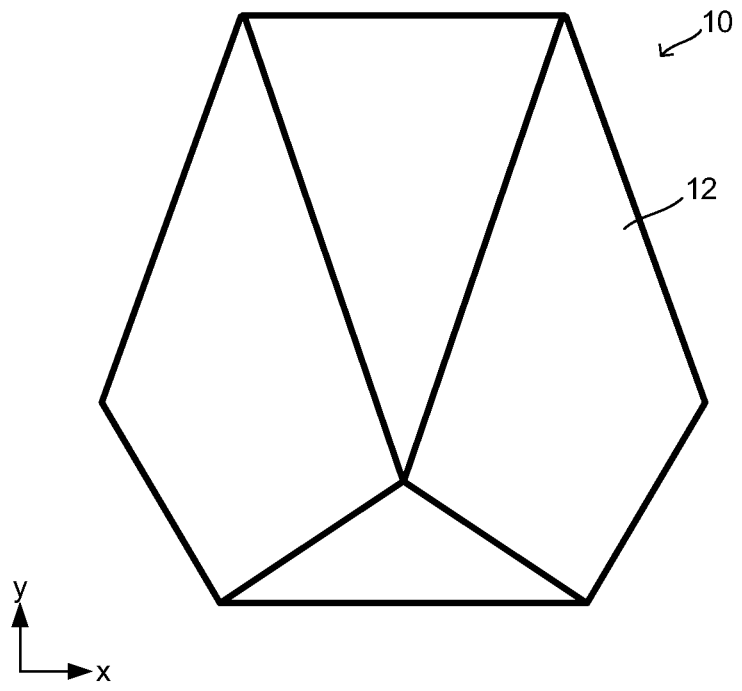
FIG. 2 is a front view of the dripping container cover 10.
Figure 3:
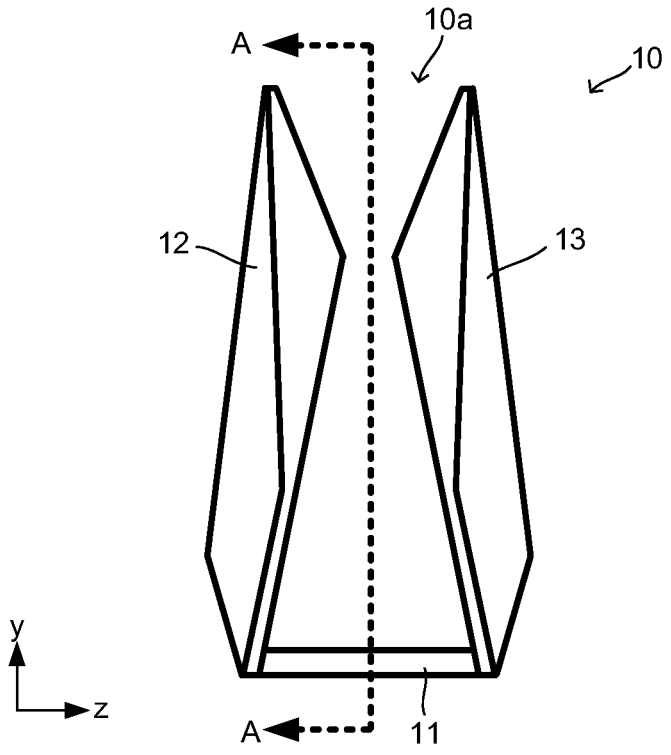
FIG. 3 is a right side view of the dripping container cover 10.
Figure 4:
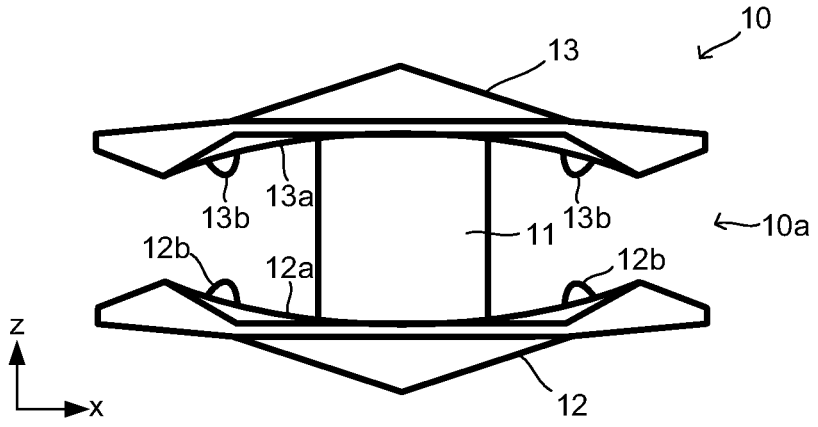
FIG. 4 is a plan view of the dripping container cover 10.
Figure 5:
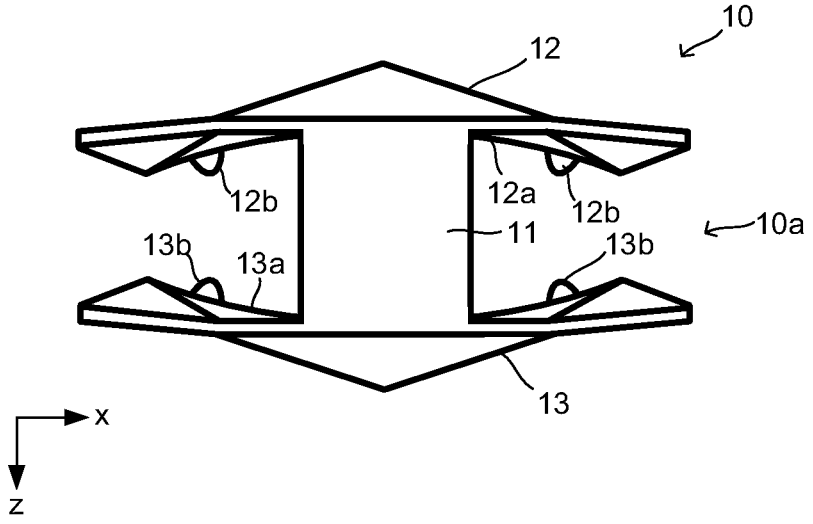
FIG. 5 is a bottom view of the dripping container cover 10.
Figure 6:
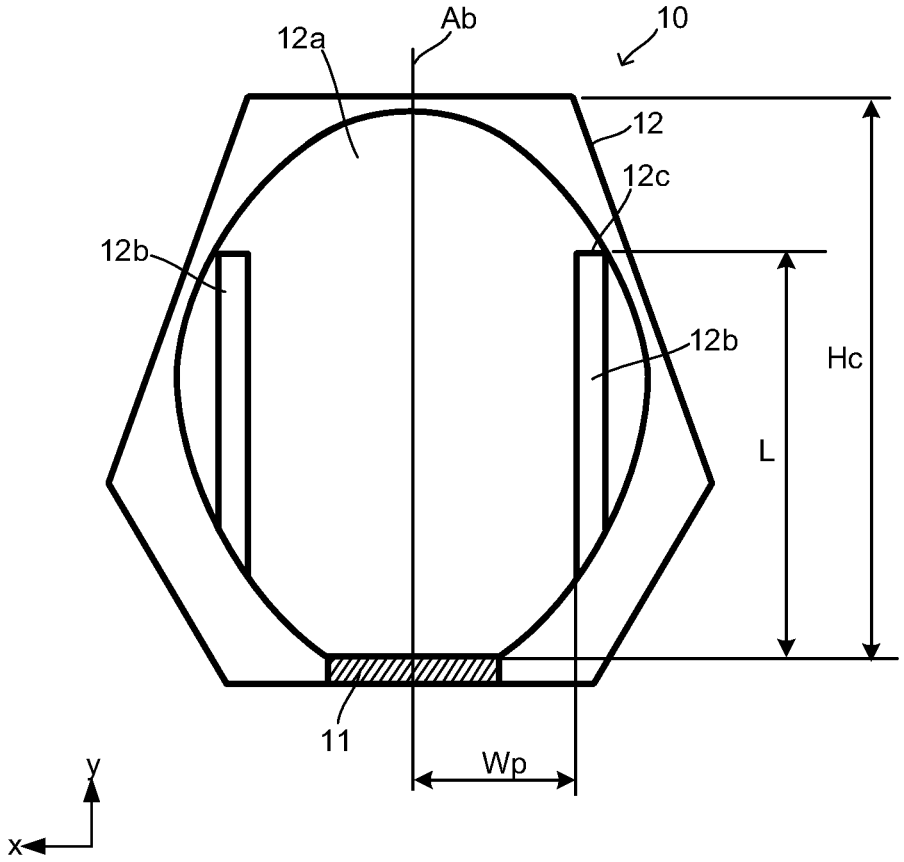
FIG. 6 is a cross-sectional view of the chipping container cover 10.

FIGS. 1 to 6 are explanatory views of the first embodiment. FIG. 1 is a perspective view of a dripping container cover 10. FIG. 2 is a front view of the dripping container cover 10. FIG. 3 is a right side view of the dripping container cover 10. FIG. 4 is a plan view of the dripping container cover 10. FIG. 5 is a bottom view of the dripping container cover 10. FIG. 6 is a cross-sectional view taken along the arrows A-A shown in FIG. 3.

Figure 7:
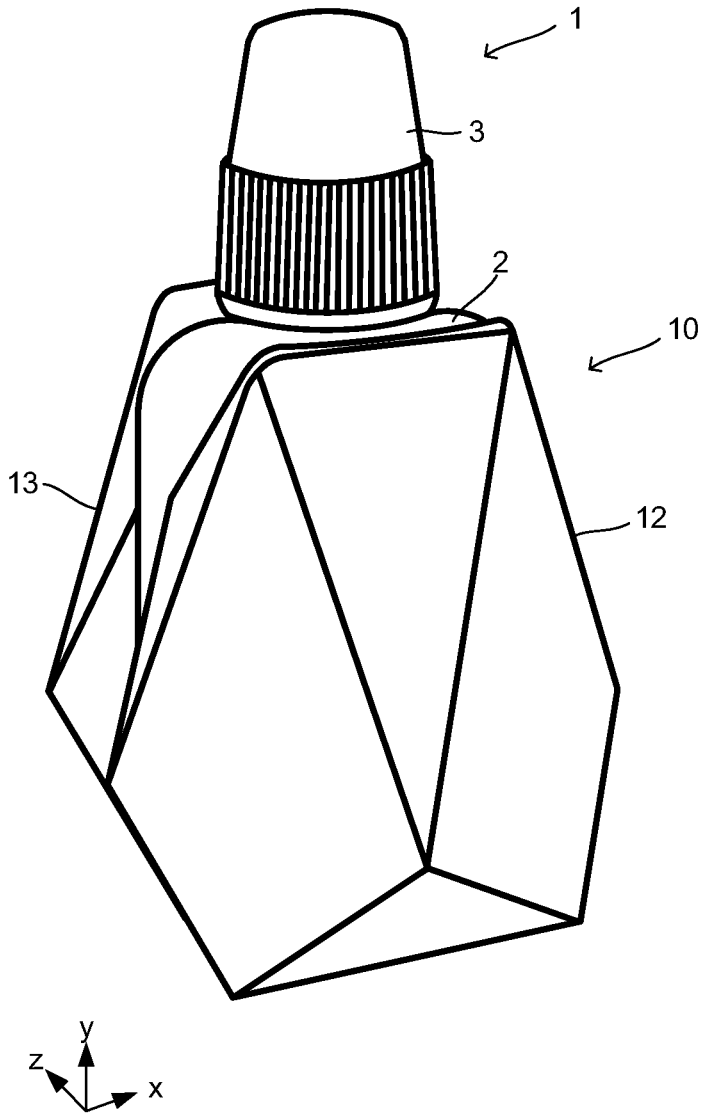
FIG. 7 is a perspective view of the dripping container cover 10 when the cover 10 is fitted onto a dripping container 1.
Figure 8:
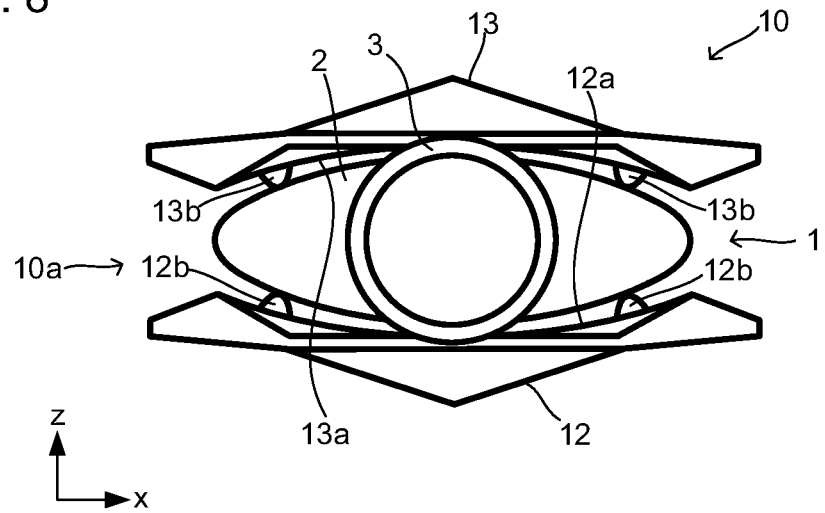
FIG. 8 is a plan view of the dripping container cover 10 when the cover 10 is fitted onto the dripping container 1.
Figure 9:
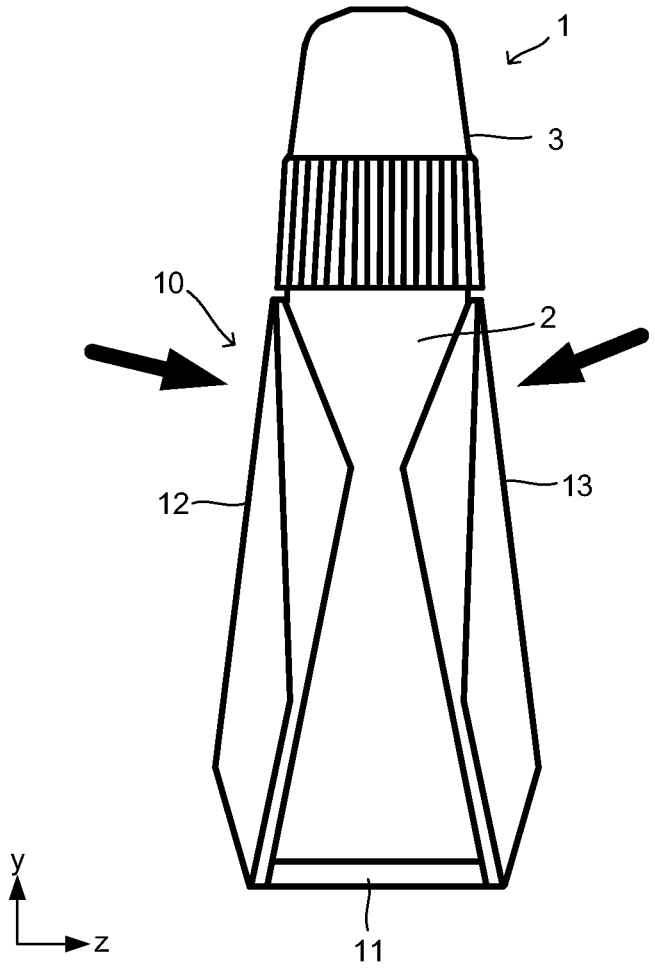
FIG. 9 is a right side view of the dripping container cover 10 when the cover 10 is fitted onto the dripping container 1.
Figure 10:
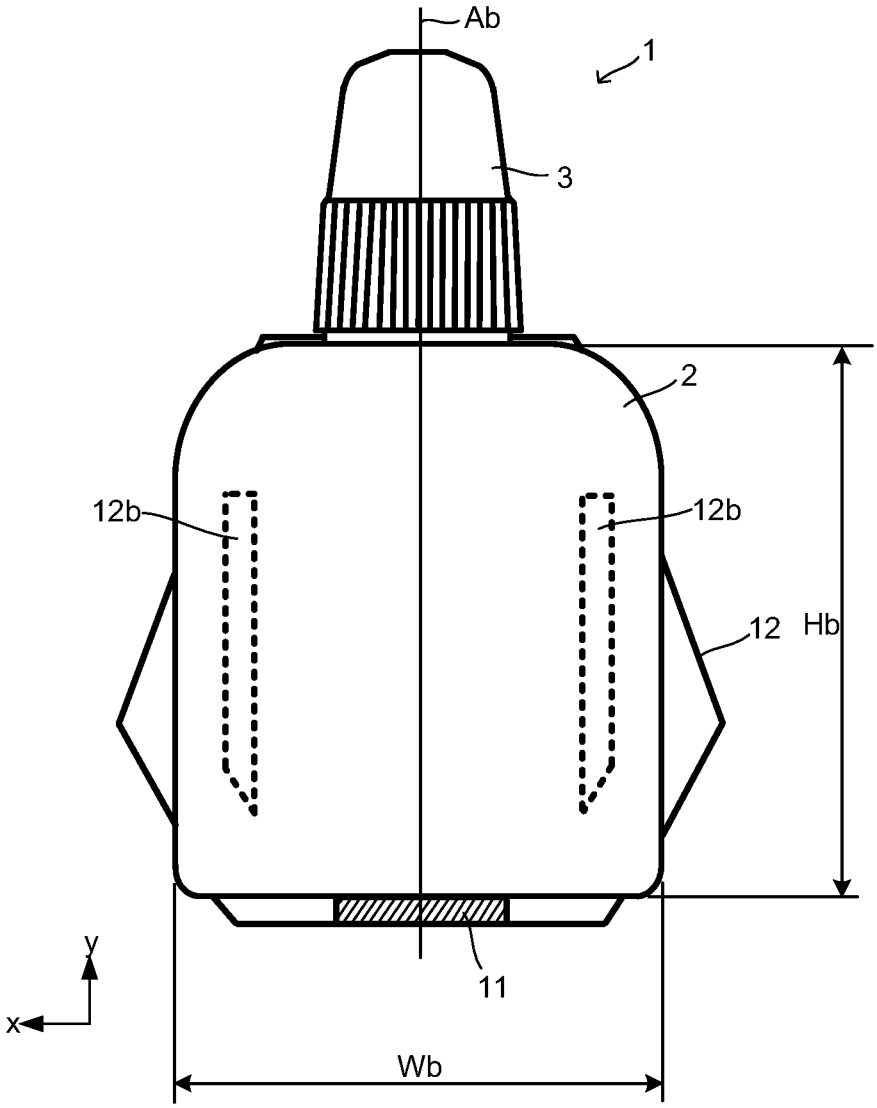
FIG. 10 shows FIG. 6 together with the dripping container 1.

Further, FIGS. 7 to 10 show the dripping container 1 disposed in the dripping container cover 10. The dripping container 1 is a container where a chemical liquid to be dripped is stored. The dripping container 1 has a cylindrical storing part 2 where a chemical liquid is stored, a dripping part (not shown) continuously formed with the storing part 2 and including a nozzle and an opening for dripping, and an attachable and detachable lid 3 for covering the dripping part. FIG. 7 is a perspective view. FIG. 8 is a plan view. FIG. 9 is a right side view. FIG. 10 is an explanatory view for a situation where the dripping container 1 is disposed, on the cross section shown in FIG. 6.

For easy understanding, these drawings also show the directions of the three-dimensional (x, y, z) orthogonal coordinate system if necessary. Here, the direction y is a height direction which is a direction where the storing part 2 and the lid 3 are aligned concerning the dripping container 1; the direction z is a thickness direction which is a direction where a first pressing part 12 and a second pressing part 13 which are described later are aligned opposite; and the direction x is a width direction which is a direction where two pressing projections 12*b* that are described later are aligned.

As can be seen from FIGS. 1 to 10, the dripping container cover 10 of the present embodiment has a bottom part 11, the first pressing part 12 and the second pressing part 13.

In this embodiment, the bottom part 11 is a tabular member. The first pressing part 12 is disposed on (protrudes from) (in this embodiment, one end or one end in the direction z of) the tabular bottom part 11. The second pressing part 13 is disposed on (protrudes from) (in this embodiment, the other end or the other end in the direction z of) the tabular bottom part 11. Then, the first pressing part 12 and the second pressing part 13 are disposed so as to face each other. Thus, the first pressing part 12 and the second pressing part 13 are disposed opposite, with a gap 10*a* in the direction z of the bottom part 11 therebetween.

As can be seen from FIGS. 7 to 10, the storing part 2 of the dripping container 1 is inserted into the gap 10*a*. The storing part 2 is disposed such that the bottom thereof is in contact with the bottom part 11 of the dripping container cover 10.

In this embodiment, the first pressing part 12 and the second pressing part 13 are, but not limited to, board-like members. The forms of the first pressing part 12 and the second pressing part 13 are not limited as long as the storing part 2 of the dripping container 1 can be inserted between the first and second pressing parts 12 and 13 and as long as the first and second pressing parts 12 and 13 include the pressing projections 12*b* and pressing projections 13*b* which are described later.

As can be seen from FIGS. 7 to 9, the board-like first and second pressing parts 12 and 13 can cover the storing part 2 of the dripping container 1 when the storing part 2 is disposed in the gap 10*a* between the first and second pressing parts 12 and 13, which can enhance heat retention, and can enhance operability for dripping.

The heights (sizes in the direction y) of the first pressing part 12 and the second pressing part 13 are not particularly limited. Preferably, the sizes are such that the entire storing part 2 is hidden and the lid 3 is exposed when the first and second pressing parts 12 and 13 are fit onto the storing part 2 of the dripping container 1 as in FIGS. 7 to 9. This facilitates opening and closing of the lid 3 while maintaining heat retention and operability.

The widths (sizes in the direction x) of the first pressing part 12 and the second pressing part 13 are not particularly limited, either. Preferably, the sizes are such that most of the storing part 2 is hidden when the first and second pressing parts 12 and 13 are fit onto the storing part 2 of the dripping container 1 as in FIGS. 7 to 9. This can maintain heat retention and operability.

The shapes of faces of the first pressing part 12 and the second pressing part 13 which are on the sides where the first and second pressing parts 12 and 13 do not face each other are not particularly limited. For example, the shapes may be elaborated in view of design. In this embodiment, the shapes are formed to be partly swell.

The form of faces of the first pressing part 12 and the second pressing part 13 which is on the sides where the first and second pressing parts 12 and 13 face each other are shown in FIG. 6. FIG. 6 shows the first pressing part 12. Since the second pressing part 13 may be considered the same as the first pressing part 12, the first pressing part 12 will be described here.

As can be seen from FIGS. 4 to 6 in particular, in this embodiment, the face of the first pressing part 12, which is on the side where the first pressing part 12 faces the second pressing part 13, has a concave portion 12*a* curving so as to be depressed in the direction z. The pressing projections 12*b*, which are projections, are provided on the surface of the concave portion 12*a*.

As can be seen from, for example, FIG. 8, the curvature of the concave portion 12*a* is preferably in the form along the curvature of the outer face of the storing part 2 of the dripping container 1, which is inserted between the first pressing part 12 and the second pressing part 13. It is not always necessary to provide the concave portion 12*a*. The face of the first pressing part 12, which is on the side where the first pressing part 12 faces the second pressing part 13, may be flat.

In most cases, the storing part 2 of the dripping container 1 is usually provided with a curved outer surface so as to be convex. Thus, the concave portion 12*a* is preferably provided in view of securer contact between the storing part 2 and the pressing projections 12*b* to make the effect thereof further remarkable.

The pressing projections 12*b* are projections provided on the face of the first pressing part 12, which is on the side where the first pressing part 12 faces the second pressing part 13. In the present embodiment, the number of the pressing projections 12*b* provided is two. These pressing projections 12*b* preferably have the following form.

The position of the pressing projections 12*b* in the height direction (direction y) is as follows.

A height (size in the direction y) of the storing part 2 of the dripping container 1 to be fitted is defined as Hb as shown in FIG. 10. A distance between an end of one of the pressing projections 12*b* which is apart from the bottom part 11 further than the other end (12*c* in FIG. 6), and a face of the bottom part 11 which is on the pressing projections 12*b* side in the direction y on the cross section shown in FIG. 6 is defined as L.

In this embodiment, L preferably has a size of 0.7·Hb or more. In other words, in this embodiment, the pressing projections 12*b* are arranged so that the ends 12*c* thereof reach positions far apart from the bottom part 11.

As described above, a distance Hc (see FIG. 6) between the face of the bottom part 11, which is on the pressing projections 12*b* side, and the upper end of the first pressing part 12 (end furthest apart from the bottom part 11) is approximately the same as Hb in many cases. In view of this, L may have a size of 0.7·Hc or more.

The positions of the pressing projections 12*b* in the width direction (direction x) are as follows.

A width (size in the direction x) of the storing part 2 of the dripping container 1 to be fitted is defined as Wb as shown in FIG. 10. The position of the axis of the storing part 2 when the storing part 2 of the dripping container 1 is disposed in the dripping container cover 10 (i.e., as shown in FIG. 10), on the cross section shown in FIG. 6 is indicated by a line Ab. A distance between this line Ab and any one of the pressing projections 12*b* (at the closest portion thereof to the line Ab) is defined as Wp.

In this embodiment, this Wp is preferably at least Wb/4. That is, the pressing projections 12*b* are arranged at positions within both outermost ranges of the storing part 2 assuming that the storing part 2 is divided into four in the width direction.

The width (size in the direction x), the length (size in the direction y) and the projecting amount (size in the direction z) of each of the pressing projections 12*b* are not particularly limited. Preferably, the width is 0.5 mm to 10 mm, the length is 10 mm to 40 mm, and the projecting amount is 1 mm to 5 mm. This results in further proper control of dripping of a chemical liquid.

Since the storing part 2 of the dripping container 1 is usually long in the y direction, each of the pressing projections 12*b* is also preferably long and narrow so that the length thereof is more than the width thereof and more than the projecting amount thereof.

The shape of a cross section of each of the pressing projections 12*b* in the direction orthogonal to the direction y (cross section taken along an xz plane) is not particularly limited, but is preferably a quadrangle or a mountain shape having the most protruding center.

Preferably, a plurality of the pressing projections 12*b* are arranged at the same position in the direction x so as to have the line of symmetry as holding the line Ab. This makes it possible to press the storing part 2 evenly. Therefore, in the present embodiment, the number of the pressing projections 12*b* disposed is preferably even. This embodiment shows an example where the number of the pressing projections 12*b* provided are two. This number may be larger, for example, four, six or eight.

The material constituting the dripping container cover 10 is not particularly limited, but is preferably a material having strength and a certain degree of elastic force. An example of this material is polypropylene.

A performer using the dripping container 1 with the storing part 2 fitted into the dripping container cover 10 of the present embodiment as described above removes the lid 3, holds the dripping part of the dripping container 1 with the bottom thereof up, and presses upper portions of the first pressing part 12 and the second pressing part 13 as shown by the solid arrows in FIG. 9 with his fingers. This leads to movement of the first pressing part 12 and the second pressing part 13 in such directions that the first and second pressing parts 12 and 13 approach each other, which causes the pressing projections 12*b* and the pressing projections 13*b* to press the storing part 2 to increase the internal pressure of the storing part 2, which makes it possible to move a chemical liquid stored in the storing part 2 to the dripping part to drip the chemical liquid.

At this time, according to the dripping container cover 10 of the present embodiment, as can be seen well from FIGS. 8 and 10, the pressing projections 12*b* and the pressing projections 13*b* disposed at the positions in the direction y and the direction x as described above press upper end portions of the storing part 2 in the width direction.

Figure 11:
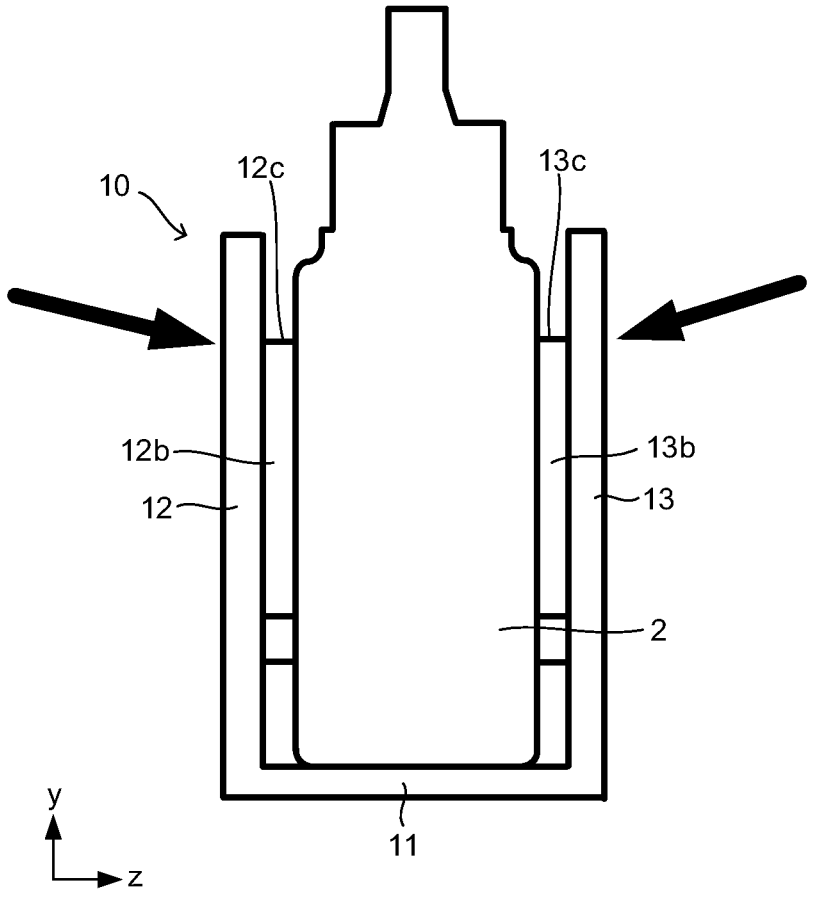
FIG. 11 is an explanatory view for pressing.

According to this, as shown in FIG. 11 showing an explanatory schematic view, the pressed places indicated by the solid arrows, and the positions of the upper ends of the pressing projections 12*b* and the pressing projections 13*b* (ends 12*c* and ends 13*c*) are substantially the same. Thus, assuming a "lever" such that a fulcrum is the bottom part 11, points of effort are the pressed places, and points of load are the pressing projections 12*b* and the pressing projections 13*b*, amplification of the force at the points of effort according to "the principle of leverage" is held small.

Further, as can be seen from FIG. 8, the pressing projections 12*b* and the pressing projections 13*b* press end portions of the storing part 2 in the width direction, which suppresses deformation of the storing part 2 by pressing. That is, because of an elliptic cylindrical shape of the storing part 2 in general, it is more difficult to concave a portion thereof closer to any end thereof more than the center thereof, which leads to suppression of deformation thereof. This leads to suppression of transmission of the pressing force, which results in suppression of the pressing force. That is, it is possible to more certainly drip as user's intension.

In other words, the pressing force is suppressed according to the dripping container cover 10 of the present embodiment even when the viscosity of a chemical liquid stored in the storing part 2 is low or when the volatility thereof is high. This suppresses excessive dripping of the chemical liquid, which leads to appropriate dripping of the chemical liquid as user's intension, to make it possible to more certainly drip as user's intension.

Second Embodiment

Figure 12:
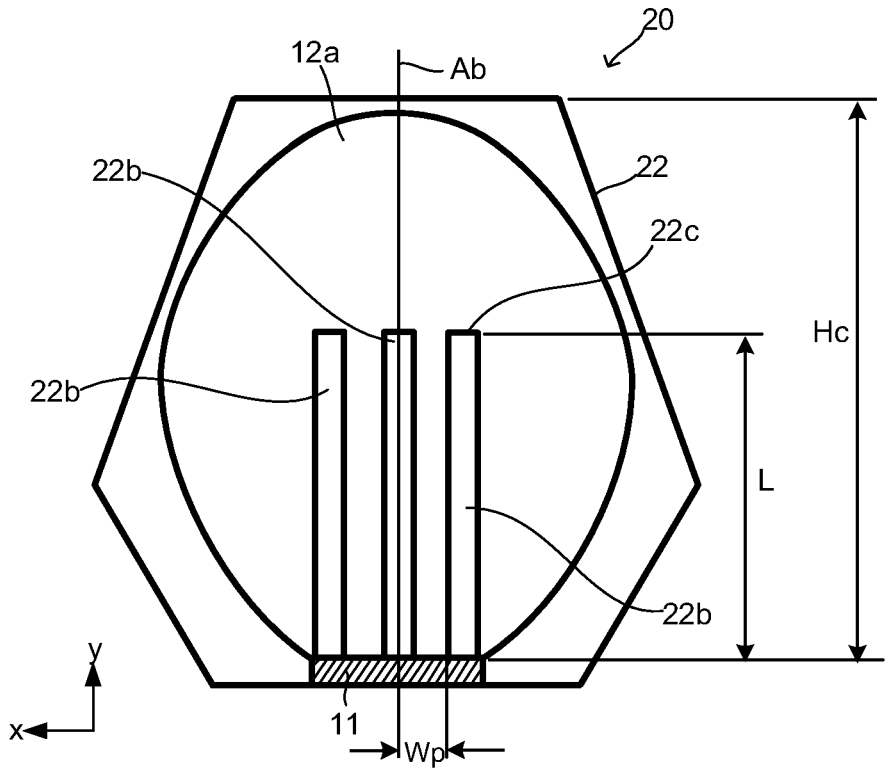
FIG. 12 is a cross-sectional view of a dripping container cover 20.
Figure 13:
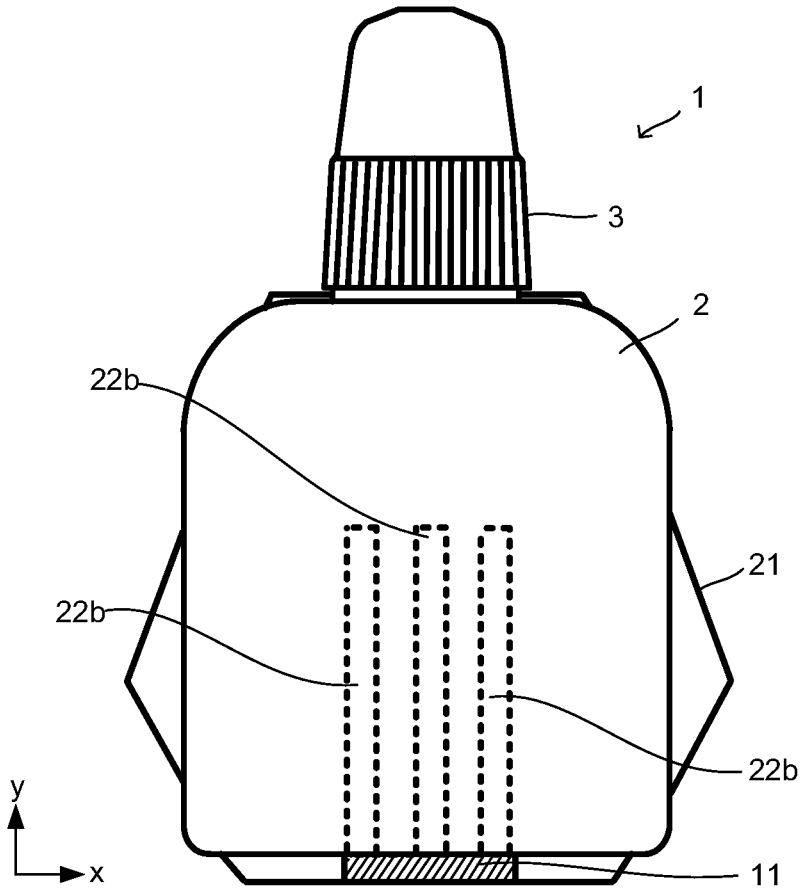
FIG. 13 shows FIG. 12 together with the dripping container 1.

FIGS. 12 and 13 explanatorily show a dripping container cover 20 of the second embodiment. FIG. 12 corresponds to FIG. 6. FIG. 13 corresponds to FIG. 10.

The dripping container cover 20 of the present embodiment is different from the dripping container cover 10 in inclusion of pressing projections 22*b* that are different from the pressing projections 12*b* of the dripping container cover 10 of the first embodiment in arrangement, instead of these pressing projections 12*b*. Since the other matters may be considered in the same manner as the dripping container cover 10, only the matters related to the pressing projections 22*b* will be described here.

As can be seen from FIGS. 12 and 13, in the present embodiment, the pressing projections 22*b* of a first pressing part 22 (as well as pressing projections 23*b* of a second pressing part 23) are located closer to the bottom part 11 in the height direction, and are arranged so as to be brought closer to the center in the width direction (the number thereof is three in total in this embodiment). This specifically means the following.

In this embodiment, the position of the pressing projections 22*b* in the height direction (direction y) is as follows.

In this embodiment, concerning the pressing projections 22*b*, L defined above is preferably has a size smaller than 0.7·Hb (0.7·Hc). In other words, in this embodiment, ends 22*c* of the pressing projections 22*b* are located closer to the bottom part 11 compared with the ends 12*c* of the pressing projections 12*b* described above.

Concerning the positions of the pressing projections 22*b* in the width direction (direction x), Wp is preferably smaller than Wb/4. Here, the meanings of Wp and Wb are the same as described above (FIGS. 6 and 10). That is, the pressing projections 22*b* are arranged at positions within the closest ranges of the storing part to the center thereof assuming that the storing part is divided into four in the width direction.

The width (size in the direction x), the length (size in the direction y), the projecting amount (size in the direction z) and cross-sectional shapes of the pressing projections 22*b* may be considered the same as those of the pressing projections 12*b*.

Since the storing part 2 of the dripping container 1 is usually long in they direction, each of the pressing projections is also preferably long and narrow so that the length thereof is more than the width thereof and more than the projecting amount thereof.

Preferably, a plurality of the pressing projections 22*b* are arranged at the same position in the direction x so as to have the line of symmetry as holding the line Ab. This makes it possible to press the storing part 2 evenly. In the present embodiment, the number of the pressing projections 22*b* disposed is three. Accordingly, one of the pressing projections 22*b* that is the center thereof is arranged so as to overlap the line Ab. This embodiment shows an example where the number of the pressing projections 22*b* provided are three. This number may be two, or may be at least four.

A performer using the dripping container 1 with the storing part 2 fitted into the dripping container cover 20 of the present embodiment as described above removes the lid 3, holds the dripping part of the dripping container 1 with the bottom thereof up, and presses upper portions of the first pressing part 22 and the second pressing part 23 in the same manner as the form shown by the solid arrows in FIG. 9 with his fingers. This leads to movement of the first pressing part 22 and the second pressing part 23 in such directions that the first and second pressing parts 22 and 23 approach each other, which causes especially the pressing projections 22*b* and the pressing projections 23*b* to press the storing part 2 to increase the internal pressure of the storing part 2, which makes it possible to move a chemical liquid to the dripping part to drip the chemical liquid.

At this time, according to the dripping container cover 20 of the present embodiment, as can be seen well from FIGS. 12 and 13, the pressing projections 22*b* and the pressing projections 23*b* disposed at the positions in the direction y and the direction x as described above press the storing part 2 at the center and therearound in the width direction at relatively low position.

Figure 14:
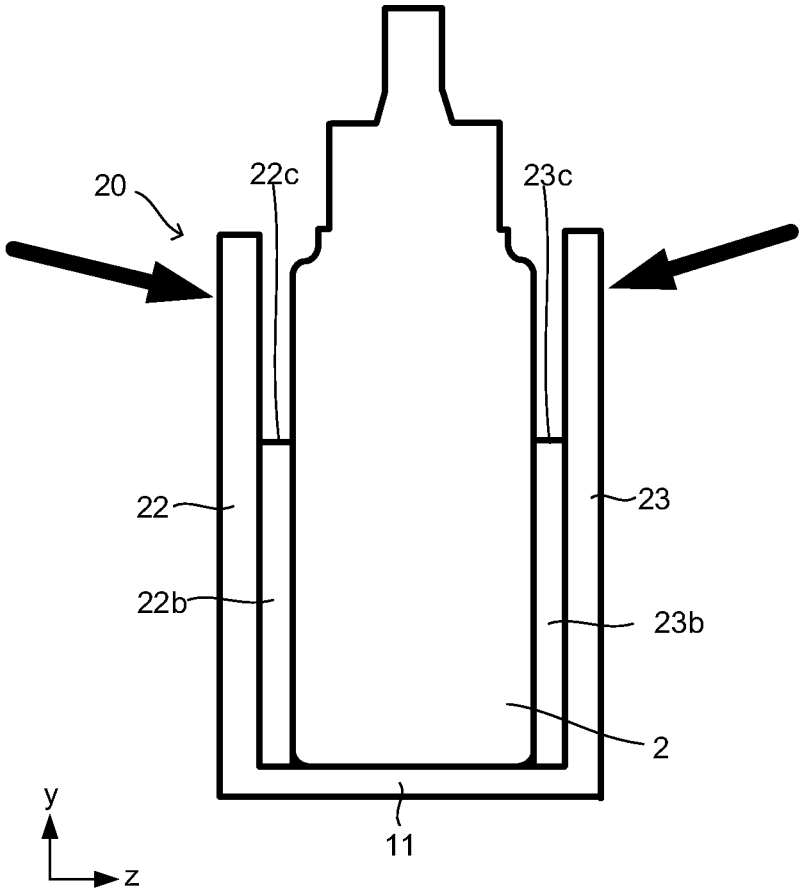
FIG. 14 is an explanatory view for pressing.

According to this, as shown in FIG. 14 showing an explanatory schematic view, the pressed places indicated by the solid arrows, and the positions of the ends 22*c* of the pressing projections 22*b* and the ends 23*c* of the pressing projections 23*b* are apart. Thus, assuming a "lever" such that a fulcrum is the bottom part 11, points of effort are the pressed places, and points of load are the pressing projections, the force at the points of effort according to "the principle of leverage" is amplified.

Further, as can be seen from FIG. 13, the pressing projections 22*b* (as well as the pressing projections 23*h*) press a central portion of the storing part 2 in the width direction, which Leads to great deformation of the storing part 2 by pressing. That is, because of an elliptic cylindrical shape of the storing part 2 in general, the central portion of the storing part 2 is easier to be concaved than the ends thereof, which makes it possible to apply the storing part 2 a stronger pressing force.

The pressing force is strengthened according to the dripping container cover 20 of the present embodiment even when the viscosity of a chemical liquid stored in the storing part 2 is high so that the chemical liquid is hard to be extruded (dripped), which makes it possible to rapidly drip the chemical liquid, to more certainly perform drip as user's intension.

REFERENCE SIGNS LIST

1 Dripping container
2 Storing part
3 Lid
10, 20 Dripping container cover
11 Bottom part
12, 22 First pressing part
12*a* Concave portion
12*b*, 22*b* Pressing projection
13, 23 Second pressing part
13*a* Concave portion
13*b*, 23*b* Pressing projection

The invention claimed is:

1. A dripping container cover fitted onto a storing part of a dripping container, a chemical liquid being stored in the storing part, the dripping container cover comprising:

a bottom part;

a first pressing part protruding from the bottom part; and a second pressing part protruding from the bottom part, the second pressing part including a face facing the first pressing part with a gap between the first and second pressing parts, wherein a face of the first pressing part which faces the second pressing part, and the face of the second pressing part, which faces the first pressing part, are each provided with projections, wherein a distance between an end of each of the projections, the end being apart from the bottom part further than the other end, and the bottom part is less than 0.7 times the height of the storing part, which is fitted into the cover, and the projections are arranged only at positions within central ranges of the storing part assuming that the storing part is divided into four in the width direction, wherein the first pressing part and the second pressing part are board members, and wherein the gap between extends in the width direction for the entire length of both of the first pressing part and the second pressing part and extends in a direction orthogonal to the width direction from the bottom part to a top end of each of the first pressing part and the second pressing part.

2. The dripping container cover according to claim 1, wherein the projections of the first pressing part are provided at such positions as to be symmetrical to each other with respect to a center of the storing part in the width direction, and the projections of the second pressing part are provided at such positions as to be symmetrical to each other with respect to a center of the storing part in the width direction.

3. The dripping container cover according to claim 2, wherein the faces of the first and second pressing parts, which face the second and first pressing parts, respectively, each have a curved concave portion, the curved concave portion including the projections.

* * * * *